US008738544B1

(12) United States Patent
Mirza et al.

(10) Patent No.: US 8,738,544 B1
(45) Date of Patent: May 27, 2014

(54) IDENTIFYING ADVOCATES AND DETRACTORS IN A SOCIAL CONNECTIONS MAP

(75) Inventors: Nasir Mohmood Mirza, Overland Park, KS (US); Jeff Howle, Gardner, KS (US); Ryan Fagan, Shawnee, KS (US); David Fairchild, Olathe, KS (US); Michael Powell, Overland Park, KS (US); Robert Earl Lee, II, Overland Park, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 0 days.

(21) Appl. No.: 13/331,323

(22) Filed: Dec. 20, 2011

(51) Int. Cl.
*G06Q 99/00* (2006.01)

(52) U.S. Cl.
USPC ..... 705/319

(58) Field of Classification Search
USPC ..... 705/319
See application file for complete search history.

(56) References Cited

U.S. PATENT DOCUMENTS

| | | | | |
|---|---|---|---|---|
| 6,597,903 | B1 | 7/2003 | Dahm et al. | |
| 7,454,357 | B2 * | 11/2008 | Buckwalter et al. | 705/346 |
| 2003/0200135 | A1 | 10/2003 | Wright | |
| 2007/0067210 | A1 * | 3/2007 | Rishell et al. | 705/10 |
| 2009/0063254 | A1 | 3/2009 | Paul et al. | |
| 2009/0171748 | A1 * | 7/2009 | Aven et al. | 705/10 |
| 2009/0190729 | A1 | 7/2009 | Chakraborty et al. | |

OTHER PUBLICATIONS

Non-Final Office Action mailed May 12, 2011 in U.S. Appl. No. 12/389,470, 15 pages.
Non-Final Office Action mailed Oct. 20, 2011 in U.S. Appl. No. 12/389,470, 20 pages.

* cited by examiner

*Primary Examiner* — Jami A Plucinski
*Assistant Examiner* — Shaun Sensenig

(57) ABSTRACT

An embodiment of the invention is directed toward identifying a number of advocates. A social-connection map for users of a wireless communications network is determined. A number of heavy users is determined based on the number of connections in a social-connection map. Advocate criteria are evaluated and used to identify a number of advocates.

19 Claims, 5 Drawing Sheets

IDENTIFYING ADVOCATES AND DETRACTORS IN A SOCIAL CONNECTIONS MAP

This Summary is generally provided to introduce the reader to one or more select concepts described below in the Detailed Description in a simplified form. This Summary is not intended to identify the invention or even key features, which is the purview of claims below, but is provided to be patent-related regulation requirements.

One embodiment of the invention includes a method of identifying a number of advocates. A social-connection map for users of a wireless communications network is determined. A number of heavy users is determined based on the number of connections in a social-connection map. Advocate criteria are evaluated and used to identify a number of advocates.

BRIEF DESCRIPTION OF THE DRAWING

Each illustrative embodiment of the present invention are described in detail below with reference to some of the attached drawing figures, and wherein.

DETAILED DESCRIPTION

Figure 1:
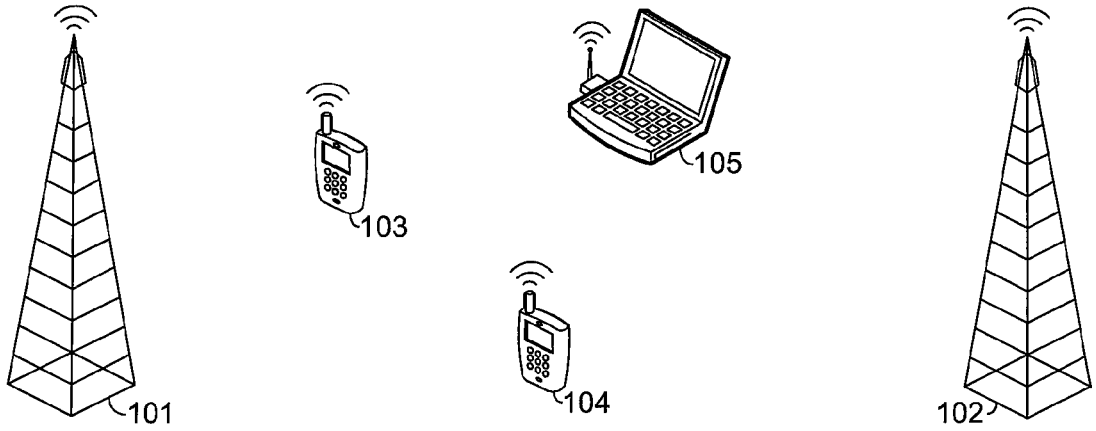
FIG. 1 is block diagram of an exemplary network suitable for practicing some embodiments of the inventions.

The subject matter of the present invention is described with specificity to meet statutory requirements. However, the description itself is not intended to define the scope of the claims. Rather, the inventors have contemplated that the claimed subject matter might also be embodied in other ways, to include different steps or combinations of steps similar to the ones described in this document, in conjunction with other present or future technologies. Moreover, although the term "step" may be used herein to connote different elements of methods employed, the term should not be interpreted as implying any particular order among or between various steps herein disclosed unless and except when the order of individual steps is explicitly described. Further, the present invention is described in detail below with reference to the attached drawing figures, which are incorporated in their entirety by reference herein.

An Embodiment of the present invention provides a way to identify advocates and detractors in a network. Advocates can include users that have a large social circle and are satisfied customers. Detractors can include users that have a large social circle and are unsatisfied customers. Both advocates and detractors, once identified, can have targeted ad campaigns directed toward them in order either shift detractors into advocate roles or to encourage advocates to remain in the advocate role. As to advocates, rewards systems may be used to increase the amount of positive word-of-mouth advertising generated by each advocate. As to detractors, incentives may be used to increase the satisfaction level, potential shifting them from the detractor group to either a neutral group or the advocate group.

In order to identify advocates and detractors, the set of users with significant social circles could be identified. A social-connection map could be built for each user. A social-connection map is a graph with the user at the center depicting a user's social network. Different data can be used in determining the set of users with significant social-connection map. First, basic user interactions could be used to build social-connection maps for each user. For example, any customer interaction could be used to add links to a user's social-connection map, depicting a user's connections. Customer interactions can include voice calls, data calls, data transmissions, text messaging, picture messaging, video messaging, and other types of multi-media messaging.

Additional customer interactions used to build a user's social-connection map could include twitter.com followers, facebook.com friends, and other social website contacts. The number of contacts in a user's contact list could also be used in determining a user's social-connection map.

A user's social-connection map could be dynamic. Each of the various data used to build a user's social-connection map could be checked on a periodic basis, thereby capturing the potentially dynamic growth. Additionally, stale links in a user's social-connection map could be removed if a particular contact has not been connected to within a particular period of time. By way of example, the period of time could be large to generate slowly changing social-connection maps (e.g., on the order of 12-24 months) or the period of time could be small to generate more responsive social-connection maps (e.g., on the order of 1-6 months).

A user could be classified as an advocate based on a number of factors. First, the number of links in a user's social-connection map could be used to determine if a user should be classified as an advocate. For example, if the number of links in a user's social-connection map exceeds a threshold number, then that user could be classified as an advocate. Additional information could also be used. The number of calls a user makes or the amount of data sent and received could be used to determine that a user is an advocate. The number of visits to a provider website and/or the lengths of those visits could be used. The use of an auto-pay system for payment of the monthly service charges could be used as an indication the user is an advocate. The number of contacts and/or the number of applications on the user's mobile device could be used as an indication that the user is an advocate. The amount of time the user has been a customer (e.g., customer tenure) and the user's upgrade history could be used as an indication that the user is an advocate. The number of calls to a call service center could also be an indication that the user is an advocate. The number of contacts of a user that have recently joined the service provider could be used to determine that a user is an advocate. External surveys could be sent to users to collect various data that would indicate the users are advocates.

Surveys could be sent to users known to be advocates. These surveys could be used to generate advocate profiles. These profiles could then be used to match other users and designate these other users as advocates.

Detractors could be determined based on a number of criteria, including the size of a user's social-connection map. For example, the number of dropped calls and/or the number of calls to a customer service call center to complain about service could be used to determine a user is a detractor. Additionally, indicators used to determine that a user is an advocate could also be used to determine a user is a detractor if those indicators fall below a certain threshold. A user could be designated a detractor if that user has a number of connections on the user's social-connection map that exceeds a threshold but has no indicators causing that user to be classified as an advocate. A user could also be classified as a detractor if a threshold number of the user's contacts have recently left the service provider.

Once advocates and detractors are identified, various marketing campaigns can be directed at those users. Marketing campaigns can be used to increase the advocating activity of advocates and potential prevent the churn of detractors. Furthermore, focused marketing campaigns could be used to convert detractors into advocates.

An embodiment of the invention is directed towards a method of identifying a number of advocates. A social-connection map for users of a wireless communications network is determined. A number of heavy users is determined based on the number of connections in a social-connection map. Advocate criteria are evaluated and used to identify a number of advocates. Marketing campaigns can be directed to the advocates. These marketing campaigns can be used to maintain advocates in their roles.

Another embodiment of the invention is directed towards a method of identifying a number of detractors. A social-connection map for users of a wireless communications network is determined. A number of heavy users is determined based on the number of connections in a social-connection map. Detractor criteria are evaluated and used to identify a number of detractors. Marketing campaigns can be directed to the detractors. These marketing campaigns can be used to change detractors into advocates.

A further embodiment of the invention is direct towards a method of identifying a number of detractors. A social-connection map for users of a wireless communications network is determined. A number of heavy users is determined based on the number of connections in a social-connection map. Advocate criteria are evaluated and used to identify a number of advocates. Detractor criteria are evaluated and used to identify a number of detractors. A first marketing campaign can be directed to the advocates. A second marketing campaign can be direct toward the detractors.

Referring initially to FIG. 1 in particular, an exemplary operating environment for implementing the present invention is shown. A wireless network including a number of basestations or towers (e.g., tower 101 and tower 102) provides wireless-service support for a plurality of mobile computing devices, including laptops 105 and handheld devices 103 and 104, such as PDAs and mobile phones. As mobile computing devices 103-105 move through the wireless network, they can use basestations 101, 102 as points of attachment to a wide area network that can include a connection to the Internet. The basestations or towers 101, 102 can be positioned throughout a geographical space in such a way as to provide wireless-signal coverage across a particular region.

Figure 2:
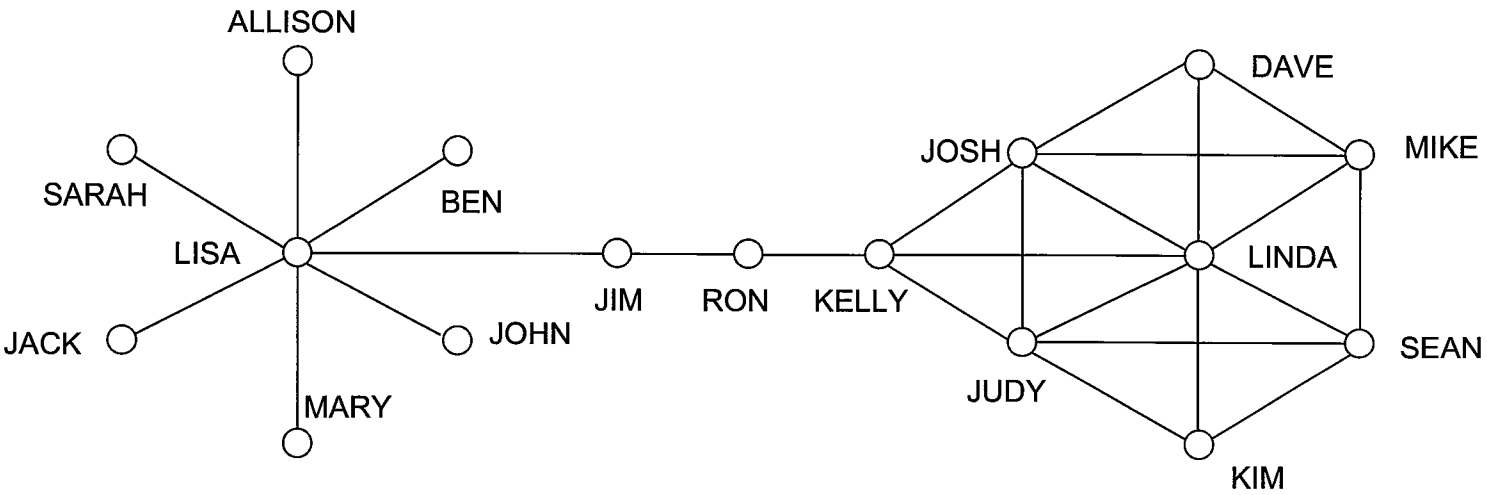
FIG. 2 is a diagram depicting an exemplary social-connection map.

Turning now to FIG. 2, a social-connection map is depicted. Each node in the social-connection map can represent a user. User's could be from a single providers network or from multiple providers' networks. Lines between nodes in the social-connection map can represent social-connections between users. Social-connections between users can be determined based on a number of different criteria. For example, data calls, text messages and picture messages between users could be used to determine connections in the social-connection map. Additionally, user's contact lists in their mobile devices could be used to determine social-connections. Other social media contacts could be used to determine connections in the social-connection map as well. For example, contacts on various social networking websites could be used (e.g., twitter.com and facebook.com). Such social-connection maps can be used to determine a range of influence for a particular user. Users with many connections in their social-connection maps could be determined to be heavy users, having a large sphere of influence. Special marketing incentives could be offered to users with large spheres of influence.

Figure 3:
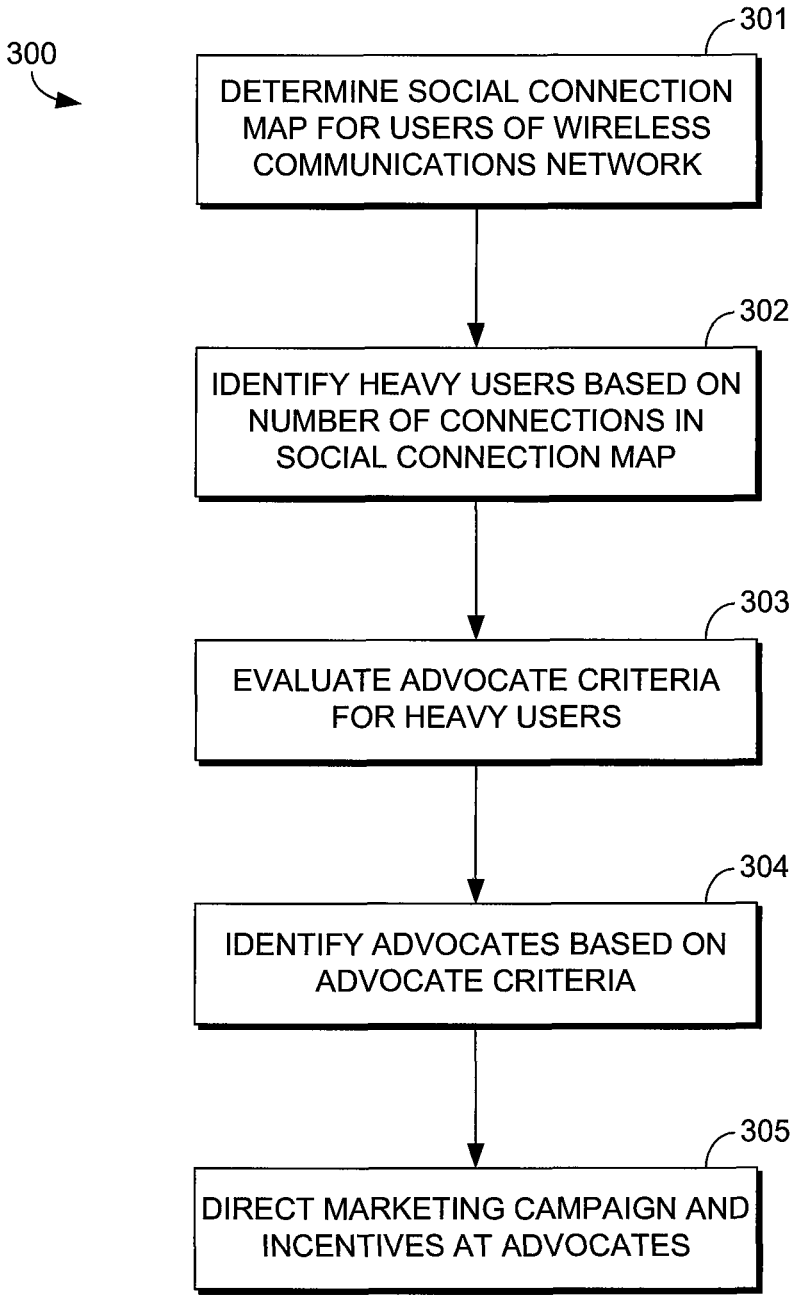
FIG. 3 is a flow diagram depicting a method of identifying and directing marketing campaigns to advocates.

Turning now to FIG. 3, a method (300) for identifying and directing marketing campaigns and incentives to advocates is depicted. At step 301, a social-connection map, similar to that described with reference to FIG. 2 is determined for a number of users of a wireless communications network. As discussed with reference to FIG. 2, a number of metrics could be used to determine the social-connection map, including, a number of voice calls, a number of data calls, a number of text messages, a number of picture messages, and a number of multimedia messages. Additionally, information about a user's contacts could be used to build the social-connection map. For example, the contacts a user stores in his or her mobile device could be used to determine a user's social-connection map. A number of other social media websites contain information that could be used to determine a user's social-connection map. For example, a user's twitter.com followers or facebook.com friends could be used in determining a user's social-connection map.

Social-connection maps could be determined using a variety of historical information. A threshold time period could be used to cause the social-connection map to be more sensitive to changes in the user's sphere of contacts. For example, only information about connections made within the last 6 months could be used in determining a user's social-connection map.

At step 302, heavy users are determined based on the social-connection map. A heavy user could be a user with a large sphere of influence. A user's sphere of influence could be based on the number of connections in a social-connection map. For example, a user with a very large number of direct connections (e.g., more than 100) in a social-connection map could be determined to be a heavy user.

At step 303, a number of advocate criteria are evaluated for heavy users. Advocate criteria can include a number of criteria useful for determining if a particular user approves of the service they are receiving from a wireless provider. For example, a number of visits to a provider website, a use of an auto-pay system for payment of monthly charges, a number of applications stored on a communications device, a number of calls to a service center, an upgrade history, a level of tenure, and a number of contacts that have recently joined a provider's service could all be used as advocate criteria.

Additionally, a profile of advocates could be created. This profile could then be matched to various user's to determine if the user is an advocate. Profile could be generated by sending surveys to known or previously identified advocates. These surveys could then be used to collect a profile on a number of metrics, such as call center calls, data usage, website usage, etc. The profile could then be used as advocate criteria, wherein any time a user's profile matches the generated profile within some particular threshold, the user is determined to be an advocate.

At step 304, advocates are identified based on the evaluation of the advocate criteria. For example, if a threshold number of criteria are met, then a user could be determined to be an advocate. At step 305, specific marketing or incentives could be directed to identified advocates. Such incentives could be used to attempt to maintain a user as an advocate or encourage the user to increase advocate type activities. Incentives could include plan discounts, special offers, and bonuses for referring new customers.

Figure 4:
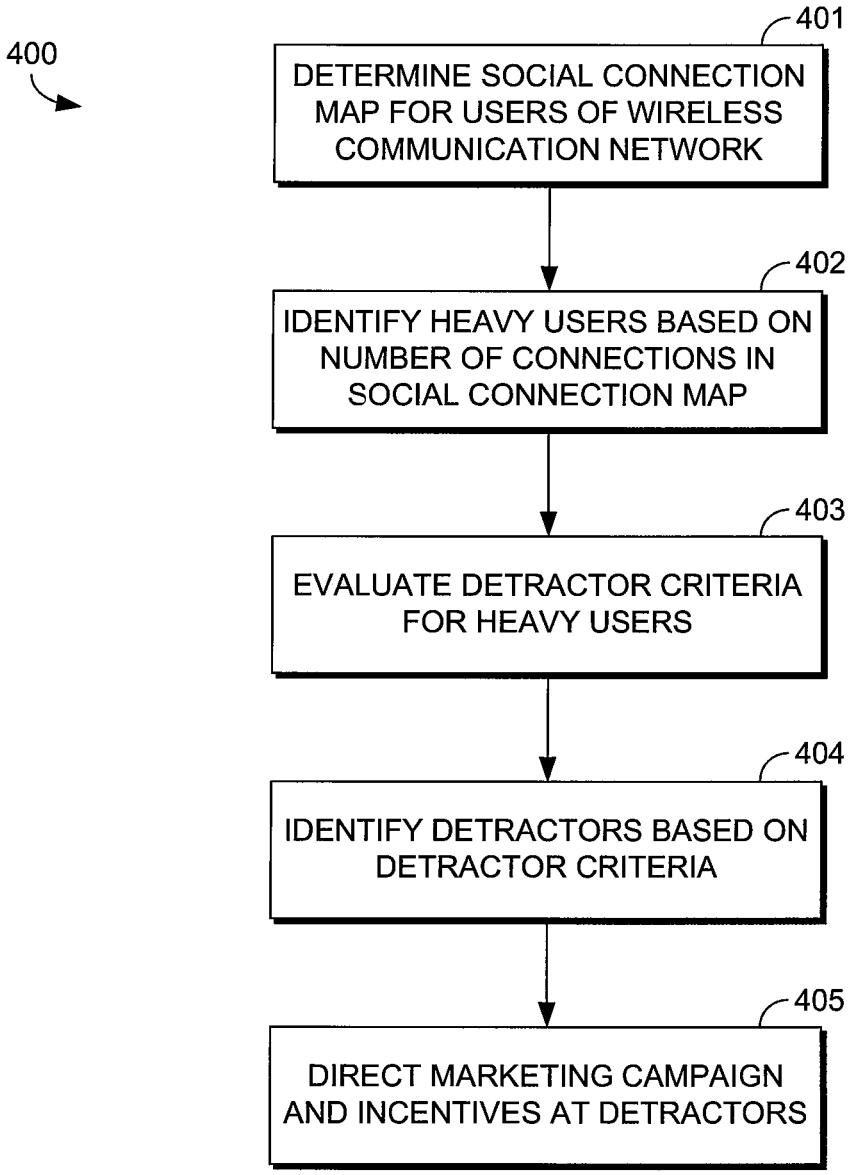
FIG. 4 is a flow diagram depicting a method of identifying and directing marketing campaigns to detractors.

Turning now to FIG. 4, a method (400) for identifying and directing marketing campaigns and incentives to detractors is depicted. At step 401, a social-connection map is determined for a number of users of a wireless communications network, similar to as described with reference to FIG. 3, step 301. At step 402, a number of heavy users are identified based on the number of connections in the social-connection map, similar to as described with reference to FIG. 3, step 302.

At step 403, a number of detractor criteria are evaluated. Detractor criteria can include criteria that tends to indicate a user has a poor view of the service offered by the wireless communications network. Such criteria could include a number of dropped calls, a number of service outages, and a number of complaint calls made to a customer service center. Additionally, detractor criteria could include a level of non-conformance with various advocate criteria. For example, if a particular user does not meet a threshold number of advocate criteria, that user could be determined to be have met a detractor criteria.

At step 404, detractors are identified based on the evaluation of the detractor criteria. For example, if a threshold number of criteria are met, then a user could be determined to be a detractor. At step 405, specific marketing or incentives could be directed to identified detractors. Such incentives could be used to attempt to changes detractors into advocates, or at least cause them to fall into a neutral category between advocate and detractor.

Figure 5:
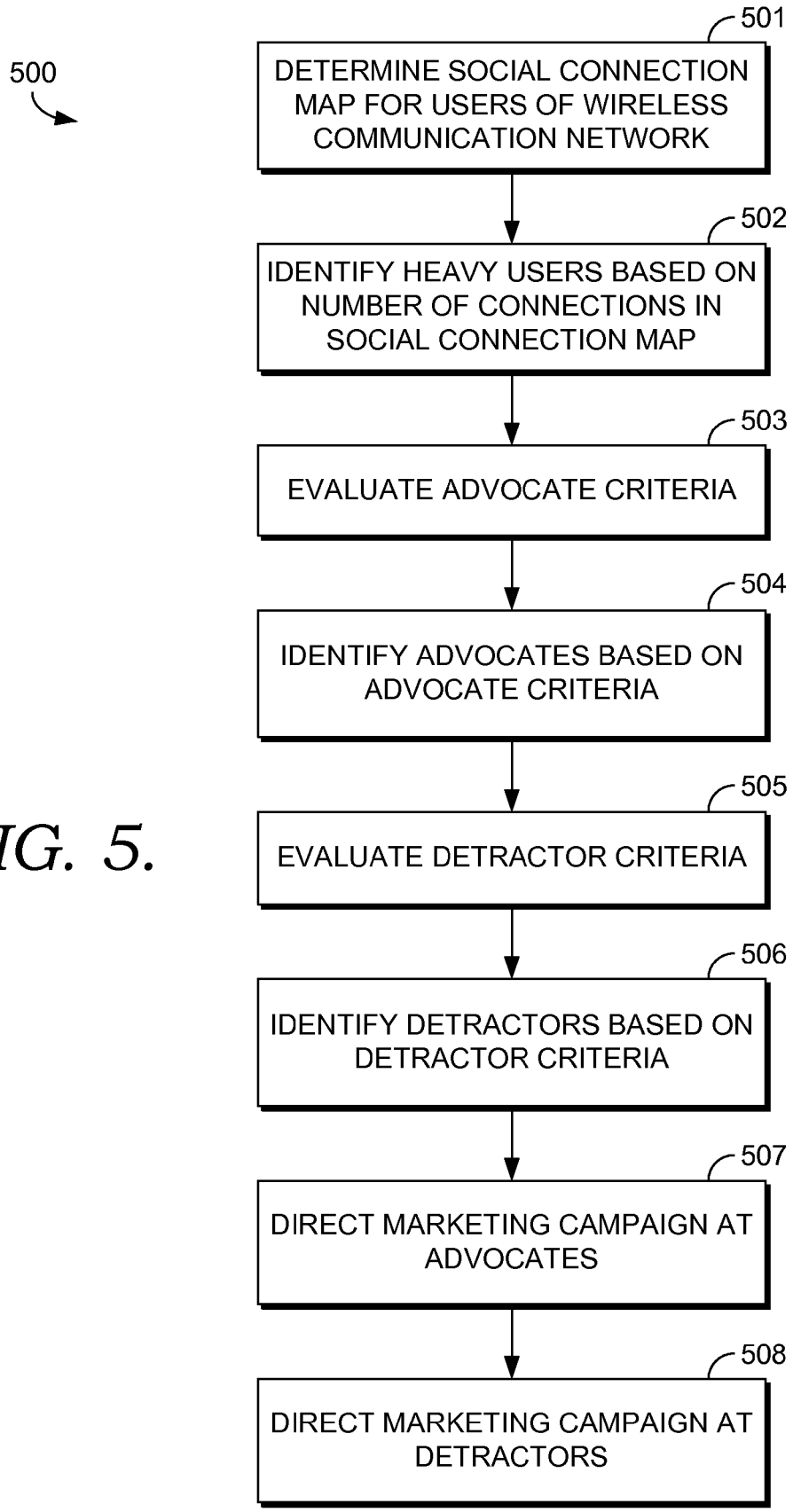
FIG. 5 is a flow diagram depicting a method of identifying advocates and detractors.

Turning now to FIG. 5, a method (500) for identifying and directing marketing campaigns and incentives to advocates and detractors is depicted. At step 501, a social-connection map is determined for a number of users of a wireless communications network, similar to as described with reference to FIG. 3, step 301. At step 502, a number of heavy users are identified based on the number of connections in the social-connection map, similar to as described with reference to FIG. 3, step 302.

At step 503, a number of advocate criteria are evaluated, similar to as described with reference to FIG. 3, step 303, and at step 504, a number of advocates are identified based on the advocate criteria, similar to as described with reference to FIG. 3, step 304. At step 505, a number of detractor criteria are evaluated, similar to as described with reference to FIG. 4, step 403, and at step 506, a number of detractors are identified, similar to as described with reference to FIG. 4, step 404.

At step 507, specific marketing or incentives could be directed to identified advocates, similar to as described with reference to FIG. 3, step 305. At step 508, specific marketing or incentives could be directed to identified detractors, similar to as described with reference to FIG. 4, step 405.

Alternative embodiments and implementations of the present invention will become apparent to those skilled in the art to which it pertains upon review of the specification, including the drawing figures. Accordingly, the scope of the present invention is defined by the claims that appear in the "claims" section of this document, rather than the foregoing description. As mentioned, some embodiments of the present invention include a variety of features. Below is a partial listing of some of those embodiments and features:

The invention claimed is:

1. Computer-readable media having computer-executable instructions embodied thereon that, when executed, enable a computing device to perform a method of identifying one or more advocates from a group of users in a wireless communications network, the method comprising:

identifying initial advocates based on user activities in the wireless communications network;

administering surveys to the identified initial advocates to collect information about user activities;

generating an advocate profile of user activities identified by the surveys completed by the identified initial advocates;

determining a social-connection map for one or more users of the wireless communications network;

identifying one or more heavy users from the one or more users, wherein the identifying of one or more heavy users is based on a count of a number of connections in the social-connection map;

obtaining a user profile of user activities for each of the one or more heavy users;

evaluating one or more advocate criteria for the one or more heavy users, wherein the evaluating one or more advocate criteria includes comparing user activities from the user profile to the generated advocate profile; and identifying the one or more advocates from the one or more heavy users based on the advocate criteria for the one or more heavy users.

2. The media of claim 1, wherein the social-connection map is determined based on interactions of the one or more users.

3. The media of claim 2, wherein the interactions comprise one or more of the following: voice calls, data calls, data transmissions, text messaging, picture messaging, video messaging, and multimedia messaging.

4. The media of claim 2, wherein the social-connection map is further determined based on social website contacts.

5. The media of claim 1, wherein the social-connection map is determined based on interactions of the one or more users occurring less than a threshold period ago.

6. The media of claim 1, wherein the advocate criteria includes one or more of the following: a number of visits to a provider website, a use of an auto-pay system for payment of monthly charges, a number of applications stored on a communications device, a number of calls to a service center, an upgrade history, a level of tenure, and a number of contacts that have recently joined a provider's service.

7. The media of claim 1, wherein the user activities for each of the one or more heavy users include one or more of call center calls, data usage, or website usage.

8. The media of claim 7, wherein the user activities for each of the one or more heavy users include one or more of number of visits to a provider website, use of an auto-pay system for payment of monthly charges, number of applications stored on a communications device, number of calls to a service center, upgrade history, level of tenure, or number of contacts that have recently joined a provider's service.

9. The media of claim 1 further comprising directing a marketing campaign at the one or more advocates.

10. Computer-readable media having computer-executable instructions embodied thereon that, when executed, enable a computing device to perform a method of identifying one or more detractors from a group of users in a wireless communications network, the method comprising:

identifying initial advocates based on user activities in the wireless communications network;

administering surveys to the identified initial advocates to collect information about user activities;

generating an advocate profile of user activities identified by the surveys completed by the identified initial advocates;

determining a social-connection map for one or more users of the wireless communications network, wherein the social-connection map depicts social connections between the one or more users, and wherein each user has a number of connections;

identifying one or more heavy users from the one or more users, wherein the identifying of one or more heavy users is based on a count of the number of connections for each user in the social-connection map;

evaluating one or more detractor criteria for the one or more heavy users; and identifying the one or more detractors from the one or more heavy users based on the detractor criteria for the one or more heavy users.

11. The media of claim 10, wherein the social-connection map is determined based on interactions of the one or more users.

12. The media of claim 11, wherein the interactions comprise one or more of the following: voice calls, data calls, data transmissions, text messaging, picture messaging, video messaging, and multimedia messaging.

13. The media of claim 11, wherein the social-connection map is further determined based on social website contacts.

14. The media of claim 10, wherein the social-connection map is determined based on interactions of the one or more users occurring less than a threshold period ago.

15. The media of claim 10, wherein the detractor criteria includes one or more of the following: a number of dropped calls and a number of complaint calls to a customer service center.

16. The media of claim 10, wherein the detractor criteria includes one more advocate criteria evaluated below a threshold level.

17. The media of claim 10 further comprising directing a marketing campaign at the one or more detractors.

18. Computer-readable media having computer-executable instructions embodied thereon that, when executed, enable a computing device to perform a method of identifying one or more advocates and one or more detractors from a group of users in a wireless communications network, the method comprising:

identifying initial advocates based on user activities in the wireless communications network;

administering surveys to the identified initial advocates to collect information about user activities;

generating an advocate profile of user activities identified by the surveys completed by the identified initial advocates;

determining a social-connection map for one or more users of the wireless communications network;

identifying one or more heavy users from the one or more users, wherein the identifying of one or more heavy users is based on a count of a number of connections of each user in the social-connection map;

evaluating one or more advocate criteria for the one or more heavy users against the advocate profile that includes user activities associated with advocates, wherein the advocate criteria include user activities of the one or more heavy users;

identifying the one or more advocates from the one or more heavy users based on the advocate criteria for the one or more heavy users;

evaluating one or more detractor criteria for the one or more heavy users;

identifying the one or more detractors from the one or more heavy users based on the detractor criteria for the one or more heavy users;

directing a first marketing campaign to the one or more advocates; and directing a second marketing campaign to the one or more detractors.

19. The media of claim 18, wherein the social-connection map is determined based on interactions of the one or more users.

* * * * *